US005318325A

United States Patent [19]

Ipsen

[11] Patent Number: 5,318,325

[45] Date of Patent: Jun. 7, 1994

[54] ADHESIVE FORM ASSEMBLY

[76] Inventor: Richard E. Ipsen, 12365 S.W. Katherine St., Tigard, Oreg. 97223

[21] Appl. No.: 967,287

[22] Filed: Oct. 26, 1992

[51] Int. Cl.[5] ..... B42D 15/00

[52] U.S. Cl. ..... 283/81; 283/101; 283/105; 40/594

[58] Field of Search ..... 283/81, 100, 101, 105; 40/158.1, 594, 644, 661

[56] References Cited

U.S. PATENT DOCUMENTS

| | | | |
|---|---|---|---|
| 2,100,840 | 11/1937 | Elmore | 40/2.2 |
| 2,100,768 | 3/1938 | Kellogg | 40/10 |
| 2,246,984 | 6/1941 | Palmer | 40/2 |
| 2,603,899 | 7/1952 | Leander | 40/125 |
| 3,487,567 | 1/1970 | Waybright | 283/81 X |
| 3,849,913 | 11/1974 | Williams, Sr. | 35/42 |
| 4,305,216 | 12/1981 | Skelton | 40/10 B |
| 4,695,077 | 9/1987 | Pretre | 283/81 |
| 4,864,755 | 9/1989 | Owens | 40/594 |
| 4,940,258 | 7/1990 | Cuba, Jr. et al. | 283/81 |
| 5,193,850 | 3/1993 | Lombardo | 283/81 |

OTHER PUBLICATIONS

"Unit Sets," Section One, *The Business Forms Handbook,* Dec., 1986 by the National Business Forms Association, pp. 117–136.

"How Business Forms Are Made," *The Business Forms Handbook,* Dec., 1986 by the National Business Forms Association, pp. 106–110.

McGarry, "Technical Update, Pressure Sensitive Adhesives," National Business Forms Association, Apr., 1991, pp. 3–5.

"Labeling Labels: Not Always Easy," article dated Aug., 1991, one page.

"The Flexographic Process–A Primer," *Business Printing Technologies Report,* Jun., 1992, pp. 3–4.

"Pressure Sensitive Labels," *The Business Forms Handbook,* Dec., 1986 by the National Business Forms Association, pp. 161–163.

McGarry, "Technical Update, Integrated Labels," article dated Aug., 1991, one page.

Samples of Labels with Transfer Tape, copyrights 1987, 1983, 1986, 1989.

Label, Versa-Tags, red in color, copyright 1982.

Label, UPS 2nd Day Air Tracking Label, blue in color, Jul., 1990.

Label, UPS C.O.D. Tag, red in color, Sep., 1988.

Label, Borden Home Wallcoverings, white in color with blue lettering (in existence before filing date).

Bar coded label, white in color, with numbers 03200 (in existence before filing date).

Label, Kelley Blue Book, white in color with blue lettering (in existence before filing date).

Label, Buyers Guide, white in color with black lettering (in existence before filing date).

Label, Versa-Tags Form Keepr, white in color with blue lettering (in existence before filing date).

*Primary Examiner*—Mark Rosenbaum
*Assistant Examiner*—Willmon Fridie, Jr.
*Attorney, Agent, or Firm*—Klarquist Sparkman Campbell Leigh & Whinston

[57] ABSTRACT

An adhesive form assembly for mounting a detachable form to a surface such as a car window. One version of a form assembly includes a two-sided form, an attachment strip surrounding the two-sided form, and a liner strip substantially coextensive with the attachment strip. The two-sided form may have one or two sheets, comprising a porous material such as paper suitable for type or hand-writing on both sides. To adhere the two-side form to a surface, the liner strip is removed to expose the adhesive layer of the attachment strip and then the exposed adhesive is placed against the surface. To remove the two-sided form from the surface, the two-sided form is detached from the attachment strip without damage because the two-sided form is removably attached to the attachment strip by a perforation. Information may be added to the two-sided form while attached to or separate from a surface. The form assembly also includes a cover sheet for creating duplicate copies of the form. In another embodiment, the form assembly may include a chemical coating between a liner sheet and a two-sided form for creating duplicate copies of the form.

15 Claims, 3 Drawing Sheets

ADHESIVE FORM ASSEMBLY

BACKGROUND OF THE INVENTION

The invention generally relates to adhesive form assemblies for mounting a form to a surface. More particularly, this invention relates to an adhesive form assembly in which a form is securely mounted to the surface, yet can be easily detached without damage.

For certain applications, forms must be reliably attached to a surface, yet must also be capable of easy removal. Federal law, for example, requires car dealers to display a form known as a "Buyers Guide" on windows of used cars before offering the cars for sale. These forms are two-sided and are typically adhesively attached to a window so that the information entered by the dealer on both sides of the form is readily visible to a buyer. The law also requires that the dealer give the buyer the original "Buyers Guide" (or accurate copy) that was displayed on the vehicle.

Typically, such forms are mounted to car windows with strips of pressure sensitive adhesives along the top and bottom of the form. While inexpensive, such forms do not remain reliably attached to the window surface. Opening and closing the window to which the form is mounted causes the form to wrinkle or even separate from the window surface. Technically a car dealer may thus violate the law unwillingly through such separation before purchase of the car. It is also important, from an aesthetic perspective that the form remains undamaged because a damaged or wrinkled form conveys an unprofessional image.

One solution to this problem is proposed in U.S. Pat. No. 4,864,755 to Owens. Owens employs a transparent oversized backing sheet adhered to the back page of a multi-part form. A marginal strip of the backing sheet surrounds the form and is covered with adhesive for securing the sheet (and form) to the window. However, while this solution solves one problem, it introduces others. It is difficult for the buyer to remove the form from the window without destroying the form adhesively attached to the backing sheet. Assuming the buyer can remove the backing sheet without destroying the attached form, then the buyer must laboriously cut off the adhesive marginal area if the back page is to be kept as a record. Furthermore, the backing sheet is made of a plastic material that by its nature is difficult to write on with ordinary ink or lead pencil. A dealer must use a fast drying solvent-based pen or a blunt writing instrument such as a grease pencil to attempt to write clearly in small areas of the form displayed through the backing sheet.

Owens recognized the first drawback of the backing sheet by providing a middle page in his form so that the back page may be discarded. But using the middle page requires the dealer to enter the same information twice—both on the middle page and the back page—since the middle page is not visible when the form is secured to the window. Moreover, the additional middle page adds to the cost of the form.

SUMMARY OF THE INVENTION

An object of the present invention is to provide an improved form assembly that overcomes the above-mentioned drawbacks of the prior art.

Another object of the invention is to provide such a form that can be easily attached and removed from a surface, yet is well secured to the surface while attached.

Yet another object of the invention is to provide a two-sided form whose two sides can be easily written upon with any ordinary ink or lead pencil while separate from or attached to a surface.

In accordance with these objects, the present invention in one embodiment is a form assembly comprising a two-sided form, an attachment strip surrounding the two-side form, and a liner strip, removably attached to and substantially coextensive only with the attachment strip to expose one side of the form. Because the attachment strip surrounds the two-sided form, the two-sided form can be easily and reliably attached to a surface. The two-side form is removably attached to the attachment strip so that the form may be removed once attached without damaging the form.

In one aspect of the invention, the form assembly may comprise a first sheet having a central area surrounded by and removably attached to an attachment strip, an adhesive layer on the inner side of the first sheet, and a second sheet adhesively attached through the adhesive layer to the first sheet. This form assembly further comprises a liner strip substantially coextensive with the attachment strip of the first sheet. The liner strip can be removed from the first sheet to expose the adhesive layer on the attachment strip. The first sheet may then be attached to a surface by the adhesive layer on the attachment strip. Finally, the central area of the first sheet is detachable from the attachment strip for removing the central area of the first sheet and the adhered second sheet from the surface.

In another aspect of the invention, the form assembly may comprise a two-sided form, an attachment strip surrounding the two-sided form, a pattern adhesive substantially coextensive only with the attachment strip, a liner sheet adhesively and removably attached to the attachment strip, and a chemical coating applied to the two-sided form between the liner sheet and the two-sided form. The attachment strip is removably attached to the two-sided form. The liner strip is adhesively and removably attached to the attachment strip by the pattern adhesive. In this alternative form assembly, the liner sheet and the two-sided form combine to create an adhesive form assembly that provides a duplicate copy of a form when information is added to the form. The chemical coating reacts in response to writing or typing on the liner sheet to create a duplicate image on the two-sided form.

The present invention also comprises a method for applying a form to a transparent surface. The method comprises providing an attachment strip around the periphery of a two-sided form and a liner strip to cover the adhesive surface of the attachment strip. Further steps include removing the liner strip from the attachment strip and applying the two-sided form to the surface by placing the adhesive surface of the attachment strip against the surface. Finally, the method comprises removing the two-sided form from the transparent surface by detaching the two-sided form from the attachment strip.

The structures and method described above provide several advantages. The form assemblies can be reliably attached to a surface because each has an attachment strip surrounding the entire form. Once attached to a surface, a form can be removed without damage and used as a record because the form can be removably attached to the attachment strip by a line of weakness such as a perforation. Because the form attached to the surface may be used as a record, the form eliminates the need for redundant copying of information to duplicates of the form. The sheets may be constructed of paper or other porous material such that one may easily write on both sides of the form. These porous sheets enable one to write on the form whether it be affixed to or separate from a surface.

These and other advantages and features will become apparent from the following detailed description and accompanying drawings which set forth the best mode for carrying out the invention.

DETAILED DESCRIPTION OF PREFERRED EMBODIMENTS

The Apparatus

Figure 1:
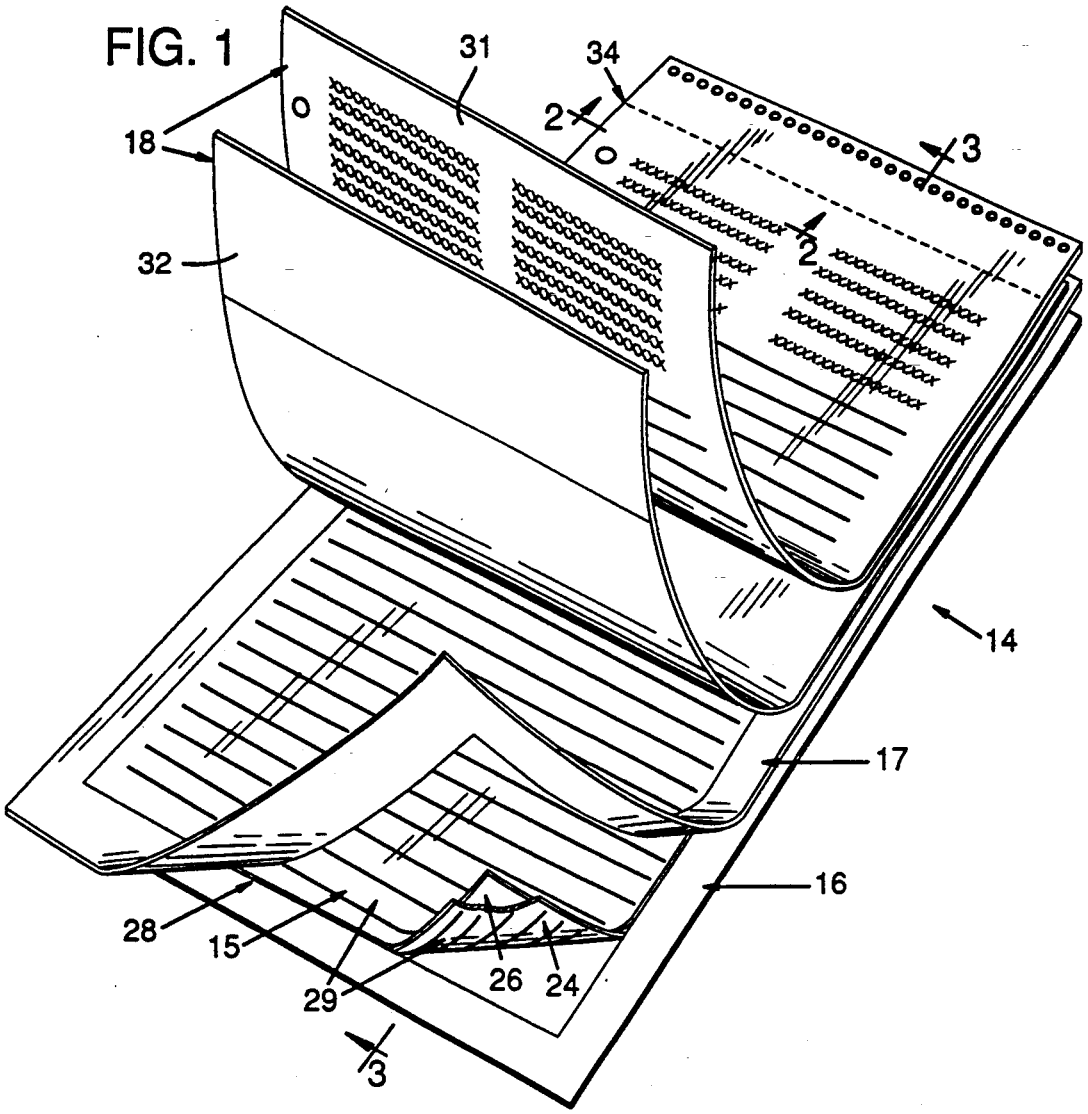
FIG. 1 is a perspective view of a form assembly according to the invention.

FIG. 1 is a perspective view of a form assembly 14 according to the invention. The form assembly 14 comprises a two-sided form 15, an attachment strip 16, a liner strip 17, and a cover sheet 18.

Figure 2:
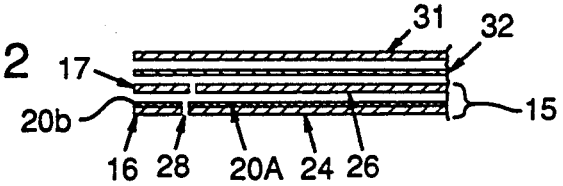
FIG. 2 is a cross-sectional view of the form assembly taken along line 2—2 of FIG. 1.

As shown in FIG. 2, the two-sided form 15 may comprise one or more sheets adhesively attached to each other by an adhesive layer 20*a*, 20*b*. In a preferred embodiment of the invention, the two-sided form includes a first sheet 24 and a second sheet 26. The perspective view of FIG. 1 shows a portion of the first sheet 24 torn away to expose the second sheet 26. To hold the central areas of the first and second sheets together, the adhesive layer 20*a* may extend between the first and second sheets 24, 26 across the entire inner side of the first sheet. The first sheet 24 of the two-sided form is removably attached to the attachment strip 16 at a line of weakness such as a perforation 28 between the attachment strip and the first sheet. The liner strip 17, substantially coextensive with the attachment strip 16, is adhesively attached to the attachment strip 16 by an adhesive layer 20*b*.

The two-sided form in the preferred embodiment is a pressure sensitive label. The first sheet, comprising the central area 24 and the attachment strip 16, is known as the face stock, and the second sheet, comprising the central area 26 and the liner strip 17, is known as a release liner to those skilled in the art. The adhesive layer 20*a*, 20*b* consists of a pressure sensitive adhesive. Specifically, the first sheet 24 is made of a material known as "Smudgeproof" because of its ability to absorb ink quickly with a minimum amount of smudging. Both sides of the two-sided form 15 are suitable for writing or printing as shown by the lines on the central area 29 of each side of the two-sided form 15. While porous sheets are recommended for the two-sided form, other materials suitable for other environments or applications could also be used in the form assembly.

Figure 3:
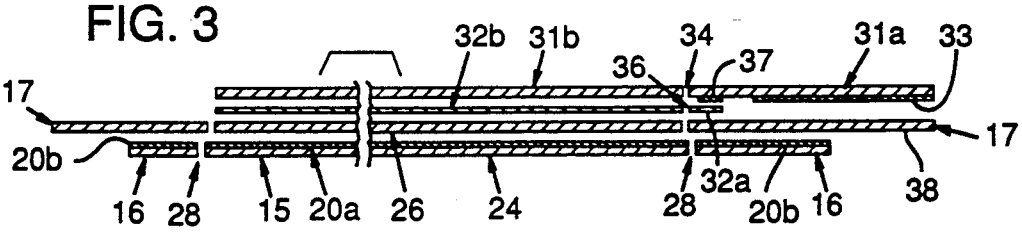
FIG. 3 is a cross-sectional view of the form assembly taken along line 3—3 of FIG. 1.

In the preferred embodiment of the invention shown in FIGS. 1–3, the cover sheet 18 includes a top sheet 31, and a carbon sheet 32 attached to the liner strip 17. The top sheet 31 is attached to the liner strip 17 by an adhesive layer 33. A line of weakness 34 of the top sheet 31 and a line of weakness 36 of the carbon sheet 32 separate the top and carbon sheets into top 31*a*, 32*a* and bottom 31*b*, 32*b* portions respectively. The top sheet 31 and the carbon sheet 32 are adhesively attached by an adhesive layer 37 above the line of weakness 34. The cover sheet 18 and the two-sided form 15 combine to create a multipart form known as a unit set.

The cover sheet 18 is optional and need not be attached to the liner strip 17 because the two-sided form may stand alone as a form. The cover sheet 18, however, may be attached on either side of the two-sided form 15. If attached to the front of the form assembly, the cover sheet 18 may be attached to the liner strip 17. If attached to the rear of the form assembly, the cover sheet 18 may be attached to an exposed side 38 of the liner strip 17 or to the attachment strip 16.

Figure 4:
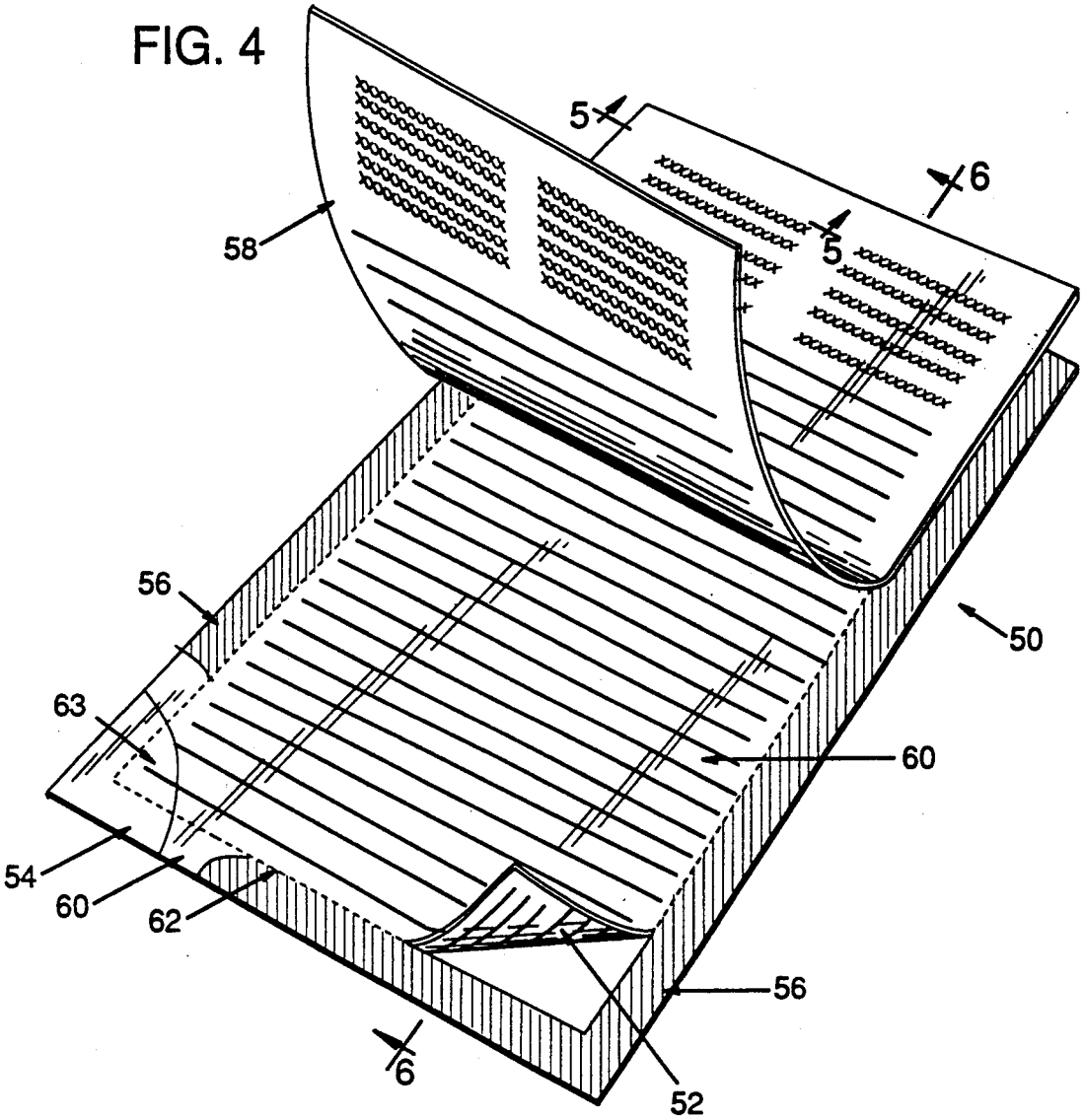
FIG. 4 is a perspective view of a form assembly according to a second embodiment of the invention.
Figure 5:
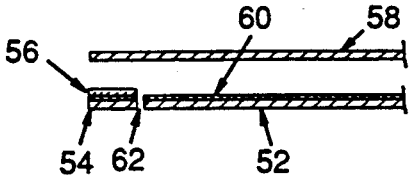
FIG. 5 is a cross-sectional view of the form assembly taken along line 5—5 of FIG. 4.
Figure 6:
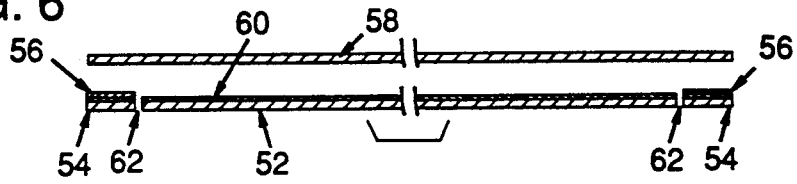
FIG. 6 is a cross-sectional view of the form assembly taken along line 6—6 of FIG. 4.

FIGS. 4–6 are several views of another form assembly 50 according to the invention. The form assembly 50 comprises a two-sided form 52, an attachment strip 54, a pattern adhesive 56, a liner sheet 58, and a chemical coating 60 between the liner sheet and the two-side form.

In this embodiment, the two-sided form 52 is removably attached to the attachment strip 54 by a line of weakness such as a perforation 62. The perforation enables one to remove the form 52 from the attachment strip as shown by the peeled-back portion of the form in FIG. 4. To illustrate that the two-sided form is suitable for writing or printing on both sides, the two-sided form 52 is peeled back in FIG. 4 to expose the lines corresponding to printed matter on both sides of the two-side form.

The liner sheet 58 is adhesively and removably attached to the attachment strip 54 by the pattern adhesive 56. The liner sheet 58 may be removed from the attachment strip 54 to expose the pattern adhesive 56 on the attachment strip 54. One may then attach the two-side form to a surface by placing the exposed pattern adhesive against the surface. The liner sheet 58, which is suitable for writing or printing on both sides, is itself a form and can be used as a record once removed.

The chemical coating 60 is applied between the liner sheet 58 and the form 52. Consisting of a carbonless imaging chemical commonly used in carbon-less paper, the chemical coating 60 reacts to pressure so that a duplicate image is formed in response to writing or typing on the face of the liner sheet 58.

In lieu of the chemical coating 60 applied to the two-sided form 52, the liner sheet 58 may have a chemical coating applied to the liner's surface between the liner sheet and the two-sided form. In this case, the liner sheet would be a silicon carbon-back imaging liner designed to create duplicate images on the two-sided form in response to writing pressure on the face of the liner sheet. In either alternative, the adhesive form assembly formed by the liner sheet and the two-sided form would be capable of producing two copies of a form.

Operation

FIGS. 7–12 show a method of applying and removing a two-sided form according to the invention. While the form assembly 14 shown in FIGS. 1–3 is specifically adapted for transparent surfaces, equivalents of the form may also be used in connection with non-transparent surfaces. The form assembly 50 of FIGS. 4–6 may also be applied with this method. FIGS. 7–12 show the method for applying a form assembly to a transparent surface, yet the method is equally applicable to non-transparent surfaces.

Figure 7:
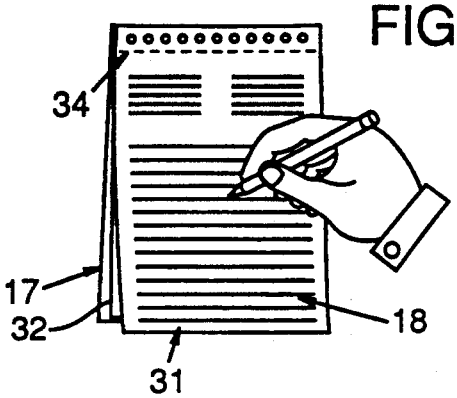
FIGS. 7–12 are pictorial views of the form assembly illustrating the operation of the invention.

As shown in FIG. 7, one may write on the top sheet 31 of the cover sheet such that the carbon sheet 32 creates a duplicate image on the two-sided form 15.

Figure 8:
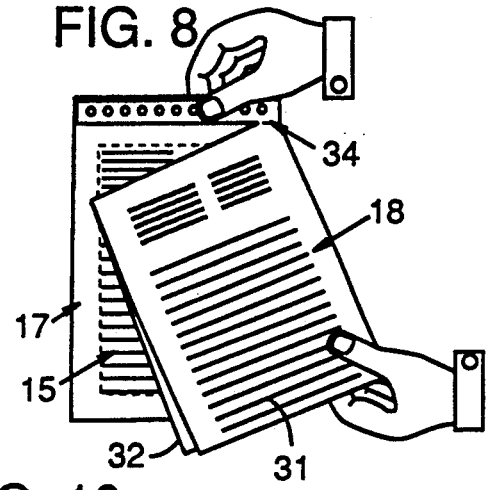

As shown in FIG. 8, one may then remove the cover sheet 18 from the liner strip 17. The perforation 34 near the upper edge of the cover sheet 18 enables one to remove the cover sheet without damaging it.

Figure 9:
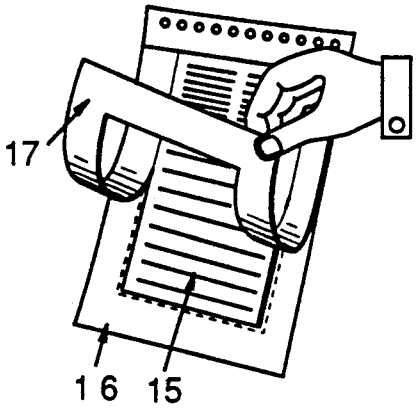

As shown in FIG. 9, one may remove the liner strip 17 from the attachment strip 16. Removal of the liner strip 17 exposes the adhesive on the attachment strip 16 so that the two-sided form 15 may be adhesively attached to a surface. FIG. 9 also shows printed matter on the front of the two-sided form 15.

Figure 10:
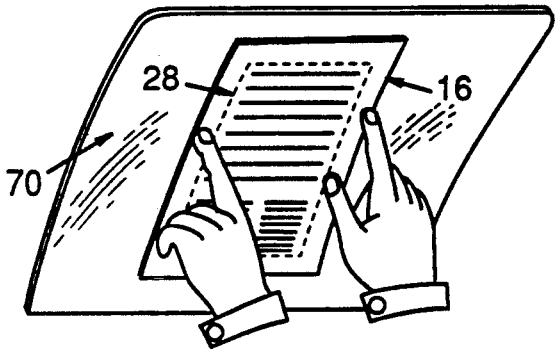

As shown in FIG. 10, one may apply the two-sided form 15 to a surface 70 by placing the adhesive surface of the attachment strip 16 against the surface 70. When applied to a transparent surface as shown, the two-sided form 15 may be read from both sides.

Figure 11:
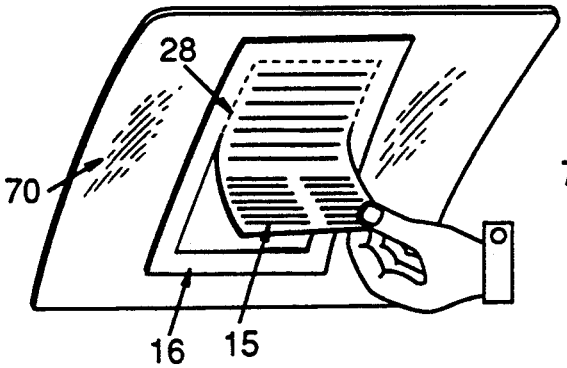

FIG. 11 shows how one may remove the form 15 from the surface 70 by detaching the form from the attachment strip 16. The two-sided form 15 is detachable from the attachment strip 16 at the perforation 28 such that the form is not damaged or destroyed. The form 15, shown in FIG. 11 with printed matter on the back side, may then be stored for record keeping without further effort.

Figure 12:
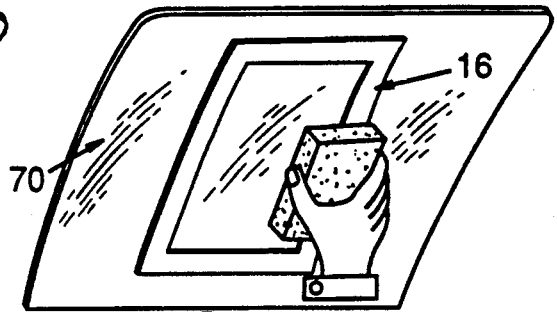

FIG. 12 shows how the attachment strip 16 may be removed from the surface 70 after the two-sided form has been detached by washing the surface with soap and water.

A Method for Manufacturing a Form

The form assembly, shown in FIGS. 1–3, is manufactured by the following process. The process begins by constructing the two-sided form. While the two-sided form may comprise a single sheet, the two-sided form resulting from this process includes first and second sheets 24, 26 adhesively attached together. An adhesive layer 20 is applied to the first sheet, and then the first and second sheets are attached to the layer.

The two-sided form 15 is then cut twice to form a liner strip 17 and an attachment strip 16 respectively. The first sheet 24 is die cut to create a perforation 28 separating the attachment strip 16 from a central area. The line of weakness comprises a plurality of cuts and ties, which hold the attachment strip and the central area together yet also enable removal of the central area without damaging the two-sided form. The second sheet 26 is die cut cleanly to define a central area surrounded by a liner strip 17. The lines formed by both cuts are slightly offset, as shown in FIGS. 2 and 3, to avoid completely cutting through the first and second sheets.

Finally, printed material is stamped on the central areas of both sheets to create a two-sided form removably attached to the attachment strip. The two-sided form may be cut and printed in one pass through a conventional flexographic press. The two-sided form, however, could be cut and printed by any equivalent printing process known to those skilled in the art. In particular, the two-sided form could be constructed to be printed by a computer printer. Additional process steps may be added to create a multipart form comprising a cover sheet and the two-sided form.

Having illustrated and described the principles of the invention in several preferred embodiments, it should be apparent to those skilled in the art that the invention can be modified in arrangement and detail without departing from such principles. For example, an adhesive layer need not extend across the entire inner side of the first sheet of the two-sided form. In one particular embodiment, the adhesive layer attaching the central area of first and second sheets of the two-sided form may extend across the inner side of the first sheet only to the extent necessary to connect the first and second sheets. The two-sided form may include only one sheet with a pattern adhesive applied to one side to attach the liner strip. Other equivalent alternatives exist. Therefore, the illustrated embodiments should be considered as examples only of preferred forms of the invention and not as limitations on the scope of the claims that define the invention.

I therefore claim all modifications and equivalents to the illustrated embodiments coming within the scope and the spirit of the following claims. The words of these claims are to be given their ordinary and accustomed meaning to one of skill in the art unless it appears that I intended to use them differently.

I claim:

1. A form assembly for attaching a form to a surface, comprising:

a two-sided form having an outer periphery;

an attachment strip surrounding the outer periphery of the two-sided form and having an inner and outer side, the two-sided form removably attached to the attachment strip by a line of weakness;

an adhesive layer on the inner side of the attachment strip; and a liner strip substantially coextensive only with the attachment strip, the liner strip being removable from the attachment strip to expose the adhesive layer for adhering the attachment strip and thereby the two-sided form to the surface, the two-sided form being detachable from the attachment strip for removal of the form from the surface.

2. The form assembly of claim 1 including a cover sheet releasably attached to the form assembly and substantially coextensive with the two-sided form and liner strip.

3. The form assembly of claim 1 wherein each side of the form contains printed matter, and the form is adherable to a transparent surface so that both sides of printed matter are visible.

4. The form assembly of claim 1 wherein the two-sided form includes a first sheet adhesively attached to a second sheet.

5. A form assembly for attaching a form to a surface, comprising:

a two-sided form including a first sheet adhesively attached to a second sheet and having an outer periphery;

an attachment strip surrounding the outer periphery of the two-sided form and having an inner and outer side, the two-sided form removably attached to the attachment strip by a perforated seam;

an adhesive layer on the inner side of the attachment strip; and a liner strip substantially coextensive only with the attachment strip.

the liner strip being removable from the attachment strip to expose the adhesive layer for adhering the attachment strip and thereby the two-sided form to the surface, the two-sided form being detachable from the attachment strip for removal of the form from the surface.

6. A form assembly for attaching a form to a surface, comprising:

a first sheet having a central area with an outer periphery surrounded by an attachment strip, the central area removably attached to the attachment strip by a line of weakness;

an adhesive layer on an inner side of the first sheet;

a second sheet adhesively attached through the adhesive layer to the first sheet; and a liner strip substantially coextensive with the attachment strip of the first sheet;

the liner strip being removable from the first sheet to expose the adhesive layer on the attachment strip to attach the first and second sheets to the surface, and the central area of the first sheet and the adhered second sheet from the surface.

7. The form assembly of claim 6 wherein the first and second sheets are paper.

8. The form assembly of claim 6 wherein the central areas of the first and second sheets are adhered together.

9. The form assembly of claim 6 wherein the first sheet is paper having an inner side and an outer side, the outer side having a porous surface.

10. The form assembly of claim 6 wherein the adhesive layer is placed across the entire inner side of the first sheet.

11. The form assembly of claim 6 including a cover sheet releasably attached to the form assembly and substantially coextensive with the second sheet.

12. A form assembly for attachment to a surface, comprising:

a two-sided form having an outer periphery;

an attachment strip removably attached by a line of weakness to the outer periphery of the two-sided form;

a pattern adhesive substantially coextensive only with the attachment strip;

a liner sheet adhesively and removably attached to the two-sided form; and a chemical coating applied between the liner sheet and the two-sided form.

13. The form assembly of claim 1 wherein the line of weakness is a perforated seam.

14. The form assembly of claim 6 wherein the line of weakness is a perforated seam.

15. The form assembly of claim 12 wherein the line of weakness is a perforated seam.

* * * * *

UNITED STATES PATENT AND TRADEMARK OFFICE

CERTIFICATE OF CORRECTION

PATENT NO. : 5,318,325

DATED : June 7, 1994

INVENTOR(S) : Richard E. Ipsen

It is certified that error appears in the above-identified patent and that said Letters Patent is hereby corrected as shown below:

Column 7, line 27, after "sheet" add --being detachable from the attachment strip for removing the central area of the first sheet--

Signed and Sealed this

Twentieth Day of September, 1994

Bruce Lehman

*Attest:*

BRUCE LEHMAN

*Attesting Officer*

*Commissioner of Patents and Trademarks*